US007300136B2

(12) United States Patent
Patterson et al.

(10) Patent No.: US 7,300,136 B2
(45) Date of Patent: Nov. 27, 2007

(54) INK TUBING CHAIN SLIDER FOR WIDE FORMAT PRINTER

(75) Inventors: Robert S. Patterson, San Diego, CA (US); Jason S. Dewey, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 380 days.

(21) Appl. No.: 11/029,080

(22) Filed: Jan. 4, 2005

(65) Prior Publication Data

US 2006/0146089 A1 Jul. 6, 2006

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS 5,686,947 A 11/1997 Murray et al.

6,637,864 B2 10/2003 Dewey et al.

FOREIGN PATENT DOCUMENTS

JP 08324055 A * 12/1996

* cited by examiner

*Primary Examiner*—Julian D. Huffman
*Assistant Examiner*—Jennifer Baer

(57) ABSTRACT

An ink jet printer includes a carriage mounted on a guide. The carriage provides a transverse movement to a printhead. The carriage includes an upper carriage component adjacent to a rear support wall of the ink jet printer and a lower carriage component mounted to the upper carriage component. A slider is disposed between the upper carriage and the rear support wall. The slider includes a rigid substrate with a hole or an eyelet forming a hole. A pin secured to the carriage engages the hole and allows the slider to rotate up to 360 degrees around the pin. The slider includes a fabric with extended fibers secured to the substrate or directly to the carriage in order to resist static charge accumulations and lower friction.

22 Claims, 6 Drawing Sheets

INK TUBING CHAIN SLIDER FOR WIDE FORMAT PRINTER

FIELD OF THE INVENTION

The present embodiments relate generally a manner of providing stabilization to a printhead carrier assembly or other linear guides.

BACKGROUND OF THE INVENTION

In many ink jet printers, sealed ink jet cartridges containing a fixed supply of ink are utilized. The cartridges are passed over the paper, and ink is ejected from the cartridge to form the image. When the ink in a particular cartridge has been depleted, the cartridge is replaced. To maximize printhead use, some printers incorporate separate stationary large volume ink supplies, and the ink in these supplies is routed via tubing from the external supply to the print cartridges. Examples of systems of this type are described in U.S. Pat. Nos. 5,686,947 and 6,637,864. The disclosures of these patents are hereby incorporated by reference in its entirety.

Print quality is highly dependent on accurate ink droplet placement on the media. Accordingly, any deviations in printhead position during printing (other than the desired printhead scanning motion across the media) can result in inaccurate drop placement and/or size, and thus reduce image quality.

One source of printhead position variation can arise from the ink supply tubing that is connected to the moving carriage that holds the ink jet cartridges. External forces from the ink supply tubing can be transmitted to the carriage, causing vibrations and other positional deviations of the cartridges as they pass over the media. In some printer embodiments, the weight of the ink supply tubing that is supported by the carriage varies with carriage position from one side of the printer to the other. In these cases, the carriage can be forced to rock backward and forward around its support shaft as the weight of the tubing increases and decreases during passes over the media. Since this positional deviation is consistent with carriage location during a scan, print errors caused by this problem appear as visible vertical banding in the printed image.

Currently, printhead carrier assemblies for printers have bushings that run on two shafts or bushings that run on a single shaft with sliders that prevent rotation of the assembly and possibly a subassembly running on a surface. In current designs, the slider is made from a low friction material, such as plastic in order to minimize friction.

Previous printers have attempted solve the vibration problem by using a plastic slider. The plastic slider is not an ideal solution because the slider is susceptible to defects on the surface of the part the slider is sliding against.

SUMMARY OF THE INVENTION

A device for use in an ink jet printer to mitigate friction caused by the weight of a carriage includes a slider and a pin. The slider includes a rigid substrate that has two sides connected at an angle between 80 degrees and 100 degrees. A hole is located in one of the sides of the substrate. The slider includes a fabric with extended fibers secured to the side that does include the hole. The fabric rests against a rear support wall of the inkjet printer and resists static charge accumulations. The pin is secured to the carriage and engages the hole. The pin allows the slider to rotate up to 360 degrees around the pin.

BRIEF DESCRIPTION OF THE DRAWINGS

In the detailed description of the preferred embodiments presented below, reference is made to the accompanying drawings, in which.

Figure 1:
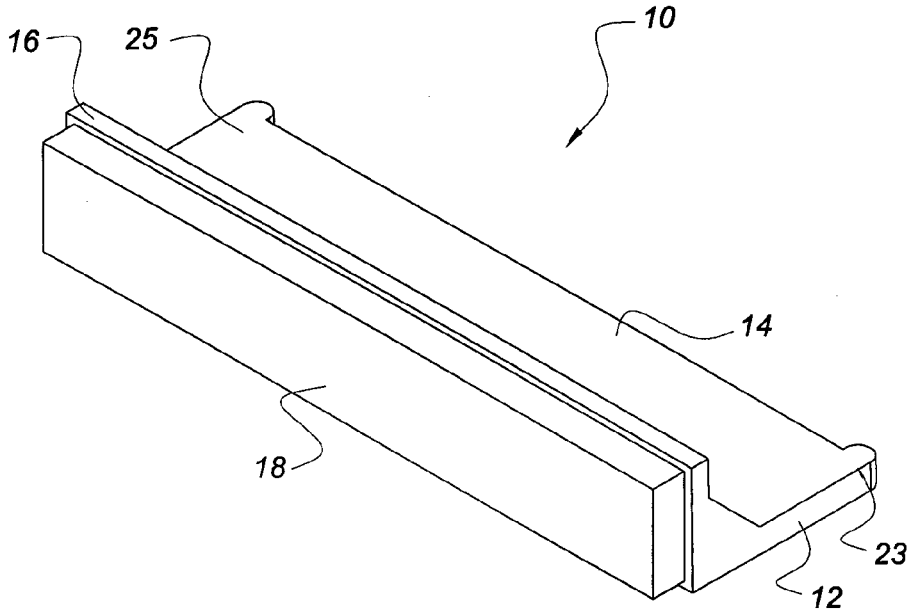
FIG. 1 depicts a perspective view of an embodiment of device for use in an ink jet printer for mitigating friction caused by the weight of a carriage.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

Embodied herein is a slider that utilizes a fabric with extended fibers, such as a closed loop fabric and does not transmit a perturbation to the carriage caused by an anomaly within typical defect dimensions on the surface that the slider is riding on. The present embodiments provide the advantage of print quality greater than those found in the current art, wherein the print quality is not adversely affected by these defects, particularly vibration defects.

The embodied closed loop fabric cleans the surface that the slider is riding on, thereby keeping contamination out the path of the slider. The contamination particles are "swept" to either end using the embodied closed loop fabric version. The interface has improved resistance to effects of contamination.

The present embodiments were designed to limit service calls, thereby saving energy due to repeated service call visits. Using the present embodiments, parts of the ink jet system last longer, thereby significantly reducing maintenance and reducing waste. Using these present embodiments, ink jet system parts can now last up to a year and beyond as determined through numerous servo cycle tests.

The most preferred embodiment contemplates simply using a closed loop fabric, like Velcro™, and attaching the fabric to a component of an ink jet printing system that slides against a support wall. The Velcro™ or similar closed loop fabric reduces static charge and removes the contaminants along the wall.

The present embodiments relate to using other types of fabric with extended somewhat shaped fibers that extend above the surface of the fabric, in a manner similar to miniature toothbrush. This embodiment provides a cleaning function without the build up of static charge.

Besides the embodiment of simply adhering, the closed loop fabric can adhere to a surface of the carriage with a pressure sensitive adhesive, such as a 3M adhesive. Typically, the closed loop fabric adheres to the carriage either on the upper component or a lower component that engages a surface. The closed loop fabric can adhere to a simple substrate that is then attached to the carriage component. The substrate provides additional support to the fabric that ensures better cleaning. Many different carriages can be retrofitted to utilize the embodied cleaning aids in order to improve print quality. In the fabric plus substrate only embodiment, the substrate can adhere to the carriage with a pressure sensitive adhesive, in the same manner as the fabric is adhered to the substrate. An epoxy can be used to adhere the fabric to the carriage or substrate.

The embodied closed loop fiber provides a low friction coefficient when contacting the surface is sliding against. The low friction coefficient allows the carriage to travel more smoothly and yield a higher, better print quality than prior printing systems. The fabric with extended fiber embodiment is selected to reduce the build up of static or other ionic charges. Additionally, stick slip is reduced and, in some cases, eliminated with the slider using the fabric with extended fibers.

In still another embodiment, the fabric with closed loop or extended fibers can be mounted to a substrate, which is of a rectangular shape. A hole is formed in the substrate and a pin is inserted through the substrate so that the assemblage, referred to herein as a "slider", can then rotate about the pin while cleaning during the movement of a carriage component.

In still another embodiment, the slider can be a substrate with a pin extending from a first side that engages the carriage of the ink jet printing system. The fabric with closed loop fiber is adhered to the second side of the substrate, opposite the first side. This embodiment allows some rotation of the slider and permits better flexibility when contamination is encountered.

Due to the flexibility of the fibers, the embodied slider can be used in either a free state with the weight of the assembly determining the position of the slider or in a fixed state with compression of the material against the surface the fabric is sliding against.

The embodied slider is particularly designed for use with ink jet printing systems; however, the slider can be used in other systems where the system requires a first part to slide against a second part. The embodied slider reduces defects in the results produced by the other system that occur when defects are present in the surface against which the parts are sliding. An example of another system where the embodied sliders are usable is a laser machining system. In a laser machining system, the lasers are mounted on a sliding carriage for cutting of material. The embodied devices can work well in photocopiers, other printing systems, such as for banners on film, and other types of printers, such as piezo printing systems.

For the ink jet printing system version, an ink jet printer includes a carriage mounted on a guide. U.S. Pat. No. 6,637,864, issued to one of the same inventors herein and hereby incorporated by reference, is an example of a typical ink jet printer.

The carriage is adapted to provide a transverse movement to the direction of print media in the printing system. The carriage in this embodiment includes an upper carriage component and a lower carriage component. The upper carriage component has a side adjacent to the rear support wall of the ink jet printer. The lower carriage component is mounted to the upper carriage component and supports the printhead. The present embodiments can be used in a single carriage design.

A slider is installed in this ink jet printer to mitigate friction caused by the weight of the carriage portion, which includes upper and lower components.

In another embodiment of the slider, a substrate with fabric disposed thereon includes a hole in the fabric. A pin is inserted in the hole around which the substrate and fabric combination rotate. The pin can be an integral protrusion of the upper carriage component or an independent part that slides through the hold.

The slider is preferably located between the upper carriage component and the rear support wall. The slider in the most preferred embodiment is simply a rigid substrate over which a fabric with extended fibers, or closed loop fibers is disposed.

In another embodiment, the slider is formed with an L-shaped substrate, wherein two portions of the substrate form the walls are connected at an angle between 80 degrees to about 100 degrees. The preferred angle is 90 degrees. The rigid substrate portions forming the L-shape can be composed of the same material or different materials.

A hole is located in the slider. The hole can be centered in the substrate on a side. The hole diameter can range from about 1/16 inch to about 1/2 inch. The hole can be in an end portion of the substrate and does not have to be centered. In the side embodiment, the hole can be formed in the substrate in order to appear as an eyelet connected to the side of the slider. The eyelet thereby forms the hole.

The rigid substrate can be made of a metal, alloys of metal, a coated metal, a rigid plastic, or combinations thereof. If a metal is used, the preferred metals are aluminum or zinc. Preferably, the rigid substrate is a durable material that is resistant to wear. If the rigid substrate is a rigid plastic, the preferred plastics are polycarbonate polymer, copolymer thereof, acrylic butyl styrene (ABS), and combinations thereof.

The rigid substrate typically has a thickness ranging from about 0.05 inches to about 0.2 inches. The preferred thickness is about 0.1 inches. The rigid substrate has an overall length ranging from about one inch to about three inches, preferably about 2 inches.

Figure 6:
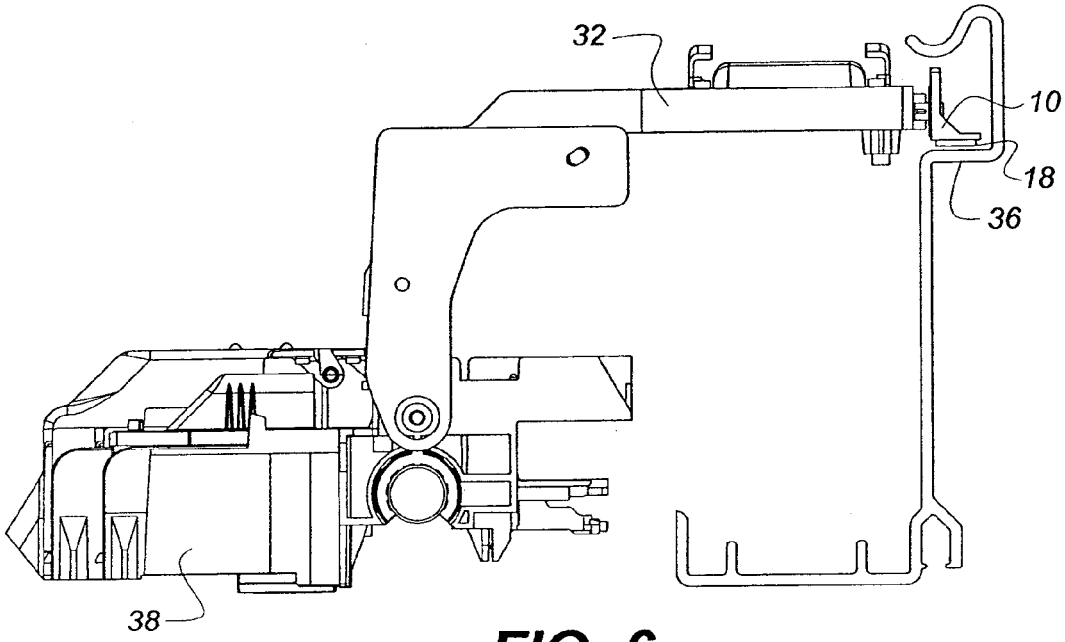
FIG. 6 depicts a non-exploded view of the embodiment depicted in FIG. 2.

The slider includes a fabric with extended fibers secured to the side of the rigid substrate and rests against a rear support wall of the inkjet printer, as depicted in FIG. 6. The fabric with extended fibers has resistance and keeps their shape. The fabric is adapted to resist static charge accumulations. The extended fibers can extend about 0.010 inches to about 0.5 inches from the base of the fabric. The preferred length of the extended fibers is 0.06 inch. The fabric itself can be a looped fabric of a non-static polymer, such as a polyamide, a polypropylene, a nylon™, or combinations thereof.

The pin used in the embodiments is secured to the carriage and engages the hole. The pin allows the slider to rotate up to 360 degrees around the pin. Preferably, the pin has a smaller diameter than the diameter of the hole or hole formed from the eyelet. The pin can be a molded feature integrally formed by material of the carriage or the pin can be threaded into the carriage when the carriage includes a threaded unit. The pin can be formed by material similar or different from the carriage, but in either case, the pin can be molded into the carriage.

With reference to the figures, FIG. 1 depicts a perspective view of an embodiment of device for use in an ink jet printer for mitigating friction caused by the weight of a carriage. The slider 10 includes a rigid substrate 12, depicted as an L-shape, with a first side 14, a second side 16, a first end 23, and a second end 25. The slider 10 includes a fabric 18 with extended fibers.

Figure 2:
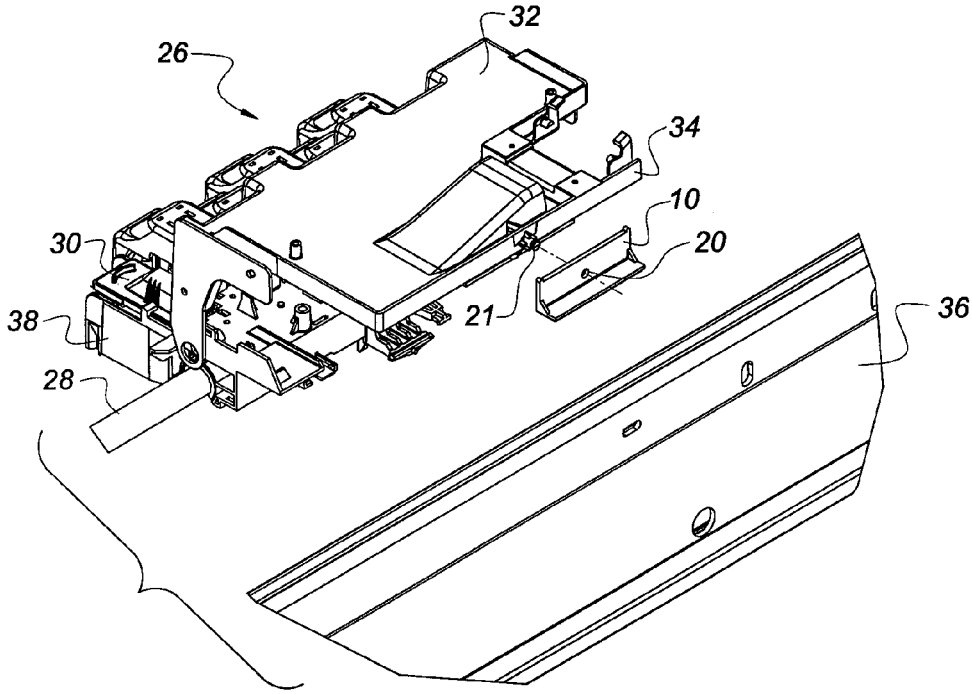
FIG. 2 depicts an exploded version of an embodiment of the device installed on a carriage.

FIG. 2 depicts an exploded version of an embodiment of the device installed on a carriage 26 of an ink jet printer. The carriage 26 has an upper carriage component 32 and a lower carriage component 38. The printhead 30 is shown disposed on the carriage 26. A guide 28 directs the movement of the carriage 26. FIG. 2 depicts the embodiment, wherein the slider 10 has a hole 20. The pin 21 inserts into the hole 20. The pin 21 engages the upper carriage component side 34 of the upper carriage component 32. The slider 10 slides against the rear support wall 36 of the ink jet printer.

Figure 3:
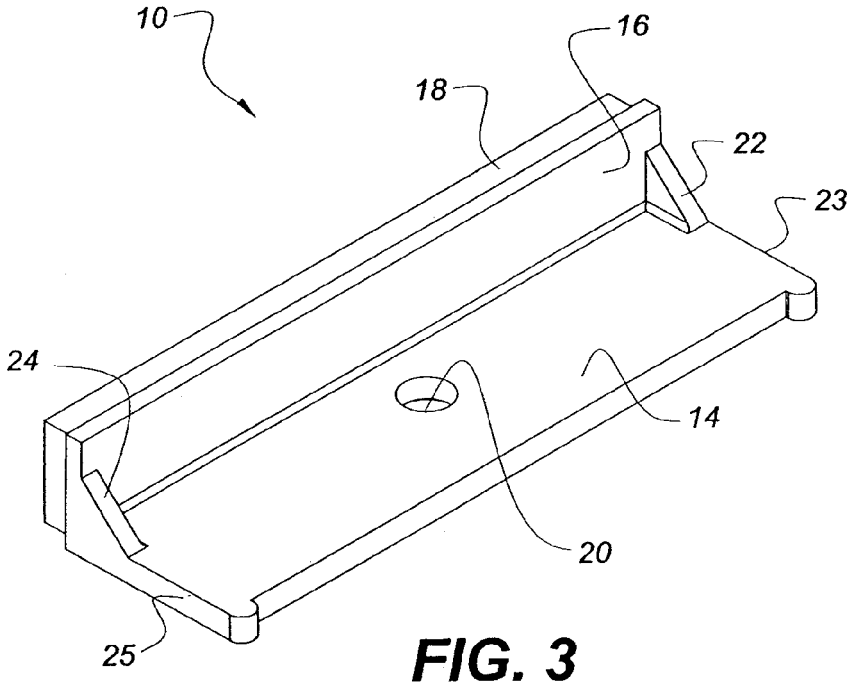
FIG. 3 depicts the gussets used in an embodiment of the slider.

As depicted in FIG. 3, the slider 10 is shown in the L-shaped embodiment, wherein the substrate sides 14 and 16 includes gussets 22 and 24. One gusset 22 is located between the sides 14 and 16 of the rigid substrate on a first end 23. A second gusset 24 is located between the sides 14 and 16 of the rigid substrate on a second end 25. The gussets 22 and 24 provide additional stiffness to maintain the angle between the sides 14 and 16 of the rigid substrate. More than one gusset can be used on the substrate. FIG. 2 depicts the embodiment of two gussets 22 and 24, wherein the fabric 18 is adhered to the second side 16 of the substrate on the side opposite of the gussets 22 and 24. The hole 20 is shown centered in the substrate. The gussets 22 and 24 can have a triangular in shape, as depicted in the figure.

Figure 4:
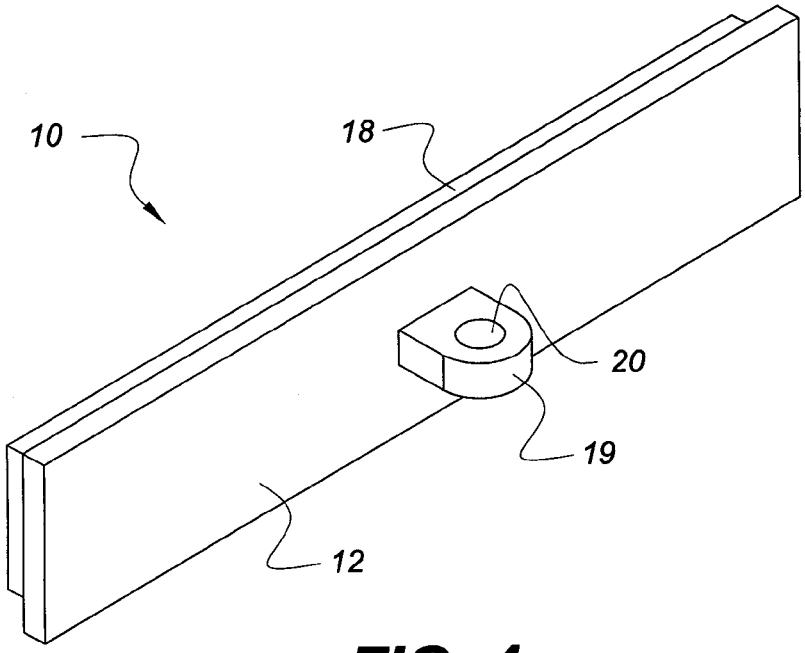
FIG. 4 depicts an alternative embodiment of the slider.

FIG. 4 depicts an embodiment of the slider 10 wherein the hole 20 is formed by an eyelet 19 extending from the rigid substrate 12. The fabric 18 is disposed on the side of the rigid substrate 12 opposite the eyelet 19 and, therefore, the hole 20.

Figure 5:
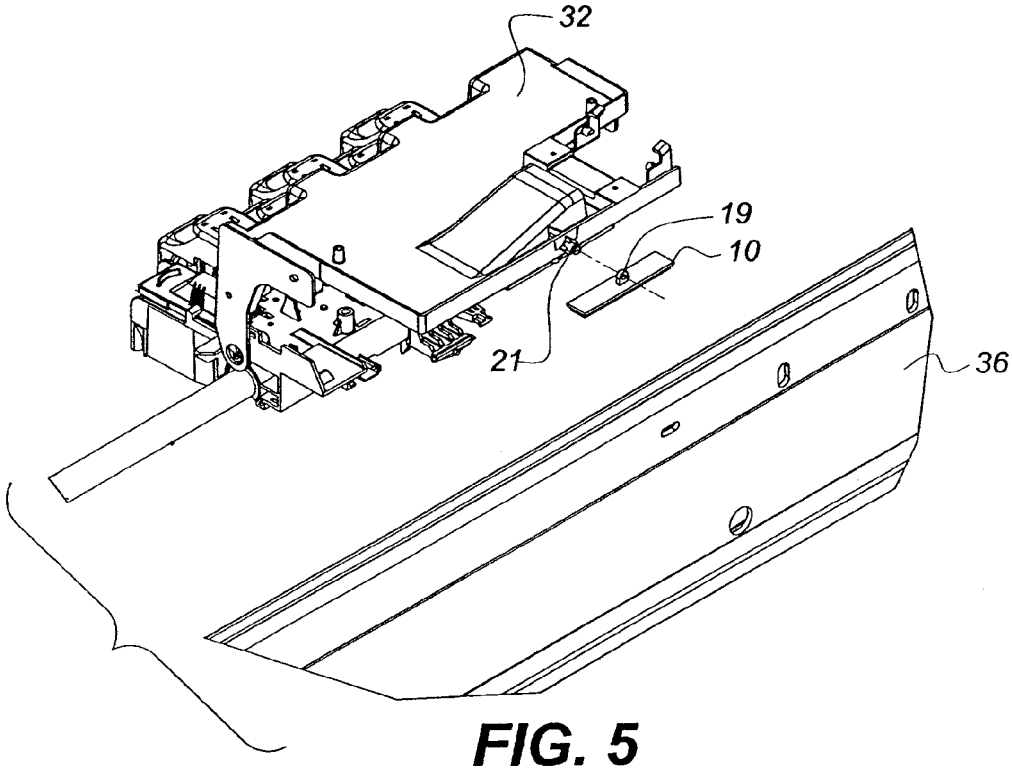
FIG. 5 depicts a detail of the embodiment of FIG. 4 installed on a carriage component of an ink jet printer.

FIG. 5 depicts a detail of the embodiment of FIG. 4 installed on a carriage 26 of an ink jet printer. The slider 10 is shown with the eyelet 19 as depicted in FIG. 4. The pin 21 inserts into the hole formed by the eyelet 19.

FIG. 6 is a side view of FIG. 2 showing the slider 10 and, particularly, the fabric 18 located against a rear support wall 36 of the inkjet printer. This engaged orientation reduces vibration and the need for constant cleaning. FIG. 6 depicts the typical orientation of the upper carriage component 32 and the lower carriage component 38.

The invention has been described in detail with particular reference to certain preferred embodiments thereof, but it will be understood that variations and modifications can be effected within the spirit and scope of the invention.

PARTS LIST

10. slider
12. rigid substrate
14 first side
16. second side
18. fabric with extended fibers
19 eyelet
20. hole
21 pin
22 gusset
23. first end
24 gusset
25 second end
26. carriage
28 guide
30 printhead
32 upper carriage component
34 upper carriage component side
36 rear support wall
38 lower carriage component

The invention claimed is:

1. A device for use in an ink jet printer for mitigating friction caused by the weight of a carriage (26), wherein the device comprises:

a. a slider (10) comprising:

i. a rigid substrate (12) comprising a first side (14) connected to a second side (16) at an angle between 80 degrees and 100 degrees;

ii. a fabric (18) with extended fibers secured to the second side (16), wherein the fabric (18) is adapted to resist static charge accumulations, wherein the fabric (18) rests against a rear support wall (36) of the inkjet printer; and iii. a hole (20) disposed in the first side (14);

b. a pin (21) secured to the carriage (26) and adapted to engage the hole (20), wherein the pin (21) allows the slider (10) to rotate up to 360 degrees around the pin (21).

2. The device of claim 1, further comprising a first gusset and a second gusset, wherein the first gusset is disposed between the first side and the second side on a first end of the rigid substrate, wherein the second gusset is disposed between the first side and the second side on a second end of the substrate, and wherein the first and second gussets are adapted to provide added stiffness to maintain the angle between the first and second side.

3. The device of claim 2, wherein the first and second gussets are triangular in shape.

4. The device of claim 1, wherein the angle is 90 degrees.

5. The device of claim 1, wherein the rigid substrate comprises an L-shape.

6. The device of claim 1, wherein the rigid substrate is a rigid plastic, a coated metal, a metal or combinations thereof.

7. The device of claim 6, wherein the metal is aluminum.

8. The device of claim 6, wherein the rigid plastic is a polycarbonate polymer, copolymer, or combinations thereof.

9. The device of claim 1, wherein the rigid substrate comprises a thickness from about 0.05 inches to about 0.2 inches.

10. The device of claim 1, wherein the rigid substrate comprises an overall length ranging from about one inch to about three inches.

11. The device of claim 1, wherein the first side comprises a metal and the second side comprises a plastic integrally connected to the first side.

12. The device of claim 1, wherein the extended fibers comprises a length ranging from about 0.010 inches to about 0.5 inches.

13. The device of claim 1, wherein the fabric is a looped fabric of a non-static polymer.

14. The device of claim 13, wherein the non-static polymer is a polyamide, a polypropylene, Velcro™, or combinations thereof.

15. The device of claim 1, wherein the hole comprises a hole diameter larger than the diameter of the pin.

16. The device of claim 15, wherein the hole diameter ranges from about 1/16 inch to about ½ inch.

17. The device of claim 1, wherein the pin is a molded feature integrally formed with the carriage.

18. The device of claim 1, wherein the pin is a separate metal or a plastic device attached to the carriage.

19. The device of claim 1, wherein the carriage comprises a threaded unit and the pin comprises a threaded end adapted to engage the threaded unit.

20. An ink jet printer comprising:

a. a carriage mounted on a guide, wherein the carriage is adapted to provide a transverse movement to a printhead, wherein the carriage comprises:

i. an upper carriage component comprising a first carriage side adjacent a rear support wall of the ink jet printer;

ii. a lower carriage component mounted to the upper carriage component, wherein the lower carriage component is adapted to support the printhead;

b. a slider disposed between the upper carriage and the rear support wall, wherein the slider comprises:

i. a rigid substrate comprising a first side connected to a second side at an angle between 80 degrees and 100 degrees;

ii. a fabric with extended fibers secured to the second side, wherein the fabric is adapted to resist static charge accumulations, wherein the fabric rests against a rear support wall of the inkjet printer; and iii. an eyelet disposed in the first side, wherein the eyelet forms a hole;

c. a pin secured to the carriage and adapted to engage the hole, wherein the pin allows the slider to rotate up to 360 degrees around the pin.

21. The ink jet printer of claim 20, wherein the ink jet printer provides a resolution comprising a dpi of at least 300.

22. An ink jet printing system comprising a carriage mounted on a guide, wherein the carriage is adapted to provide a transverse movement to a printhead, and wherein the carriage comprises:

a. an upper carriage component comprising a first carriage side adjacent a rear support wall of the ink jet printer;

b. a lower carriage component mounted to the upper carriage component, wherein the lower carriage component is adapted to support the printhead; and c. a fabric with extended fibers attached to the upper carriage and disposed between the upper carriage and the rear support wall.

* * * * *